US006850207B2

(12) United States Patent
Chen

(10) Patent No.: US 6,850,207 B2
(45) Date of Patent: Feb. 1, 2005

(54) ANTENNA COUPLER HAVING A PICK-UP SURFACE TO FACILITATE SURFACE MOUNTING

(75) Inventor: Wei-Chen Chen, Hsin-Tien (TW)

(73) Assignee: EMI Stop Corp., Hsin-Tien (TW)

( * ) Notice: Subject to any disclaimer, the term of this patent is extended or adjusted under 35 U.S.C. 154(b) by 0 days.

(21) Appl. No.: 10/373,351

(22) Filed: Feb. 24, 2003

(65) Prior Publication Data

US 2004/0095290 A1 May 20, 2004

(30) Foreign Application Priority Data

Nov. 18, 2002 (TW) ..... 91218506 U

(51) Int. Cl.[7] ..... H01Q 1/22
(52) U.S. Cl. ..... 343/878; 343/888
(58) Field of Search ..... 343/878, 888, 343/702

(56) References Cited

U.S. PATENT DOCUMENTS 3,560,981 A * 2/1971 Pestka ..... 343/702

* cited by examiner

*Primary Examiner*—Michael C. Wimer
(74) *Attorney, Agent, or Firm*—Marger Johnson & McCollom, PC

(57) ABSTRACT

An antenna coupler includes a base part, a clamping part, a pick-up part, and at least one soldering part. The base part has a pair of first edge portions opposite to each other in a first direction, and a pair of second edge portions opposite to each other in a second direction transverse to the first direction. The clamping part includes first and second clamping arms that extend respectively from the first edge portions of the base portion in a third direction transverse to the first and second directions. The pick-up part extends from a distal end of the first clamping arm that is distal from the base part toward the second clamping arm in the first direction and defines a pick-up surface opposite to the base part. Each soldering part extends in the second direction from the respective second edge portion.

13 Claims, 4 Drawing Sheets

ANTENNA COUPLER HAVING A PICK-UP SURFACE TO FACILITATE SURFACE MOUNTING

CROSS-REFERENCE TO RELATED APPLICATION

This application claims priority of Taiwanese application No. 091218506, filed on Nov. 18, 2002.

BACKGROUND OF THE INVENTION

1. Field of the Invention

The invention relates to an antenna coupler, more particularly to an antenna coupler having a pick-up surface to facilitate surface mounting.

2. Description of the Related Art

Antenna couplers are used for fastening an antenna on a circuit board. As shown in FIG. 1, a conventional antenna coupler 91 includes a base part 93 and a pair of clamping arms 94. The base part 93 has a pair of edge portions opposite to each other in a first direction. The clamping arms 94 extend respectively from the edge portions of the base part 93 in a second direction transverse to the first direction, confine a clamping space 90 therebetween, and are adapted to clamp a rod section 95 of an antenna. The clamping arms 94 have adjacent first edges that extend in the second direction and that have a pair of first guide flanges 96 formed respectively thereat, and adjacent second edges that are opposite to the first edges and that have a pair of second guide flanges 98 formed respectively thereat. The first and second guide flanges 96, 98 confine respective first and second converging entrances for guiding insertion of the rod section 95 of the antenna into the clamping space 90. The base part 93 and the clamping arms 94 are formed integrally from a metal plate that is folded at junctions of the base part 93 and the clamping arms 94.

There are several drawbacks associated with the conventional antenna coupler 91. First, the conventional antenna coupler 91 does not have a surface suitable for application of a suction force to facilitate surface mounting of the same on a circuit board 92. Second, when several conventional antenna couplers 91 are collected in one place, the conventional antenna couplers 91 are likely to entangle with each other. As such, additional time is needed for disentangling before the conventional antenna coupler 91 can be mounted on the circuit board 92. Third, the conventional antenna coupler 91 is mounted on the circuit board 92 by soldering directly a bottom surface of the base part 93 on the circuit board 92. As such, solder material may spread over the junctions of the base part 93 and the clamping arms 94, which reduces resiliency of the clamping arms 94 that can inhibit effective clamping of the antenna. Fourth, after the conventional antenna coupler 91 is mounted on the circuit board 92, cables (not shown) of test equipment (not shown) can be easily caught between the clamping arms 94. As such, the clamping arms 94 may be deformed and unable to clamp properly the rod section 95 of the antenna. Finally, when the antenna is inserted in an inappropriate manner such that the rod section 95 of the antenna applies a pushing force on the clamping arms 94, one of the clamping arms 94 may be pushed beyond a certain distance away from the other clamping arm 94 and may not be able to spring back to its original position. As such, the clamping arms 94 of the conventional antenna coupler 91 are easily damaged.

SUMMARY OF THE INVENTION

Therefore the object of the present invention is to provide an antenna coupler that has a pick-up surface and at least one soldering part so as to overcome the aforesaid drawbacks of the prior art.

According to the present invention, an antenna coupler comprises abase part, a clamping part, a pick-up part, and at least one soldering part. The base part has a pair of first edge portions opposite to each other in a first direction, and a pair of second edge portions opposite to each other in a second direction transverse to the first direction. The clamping part includes first and second clamping arms that extend respectively from the first edge portions of the base portion in a third direction transverse to the first and second directions. The first and second clamping arms are adapted to clamp a rod section of an antenna therebetween. The pick-up part extends from a distal end of the first clamping arm that is distal from the base part toward the second clamping arm in the first direction. The pick-up part defines a pick-up surface opposite to the base part and adapted to be applied with a suction force for moving the antenna coupler onto a circuit board. Each soldering part extends in the second direction from the respective second edge portion and is adapted to be soldered on the circuit board.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

In order to facilitate describing direction in the following disclosure, direction axes are included in FIG. 2. In the descriptions, first, Second, and third directions are equivalent to the X, Y, and Z axes, respectively.

Figure 1:
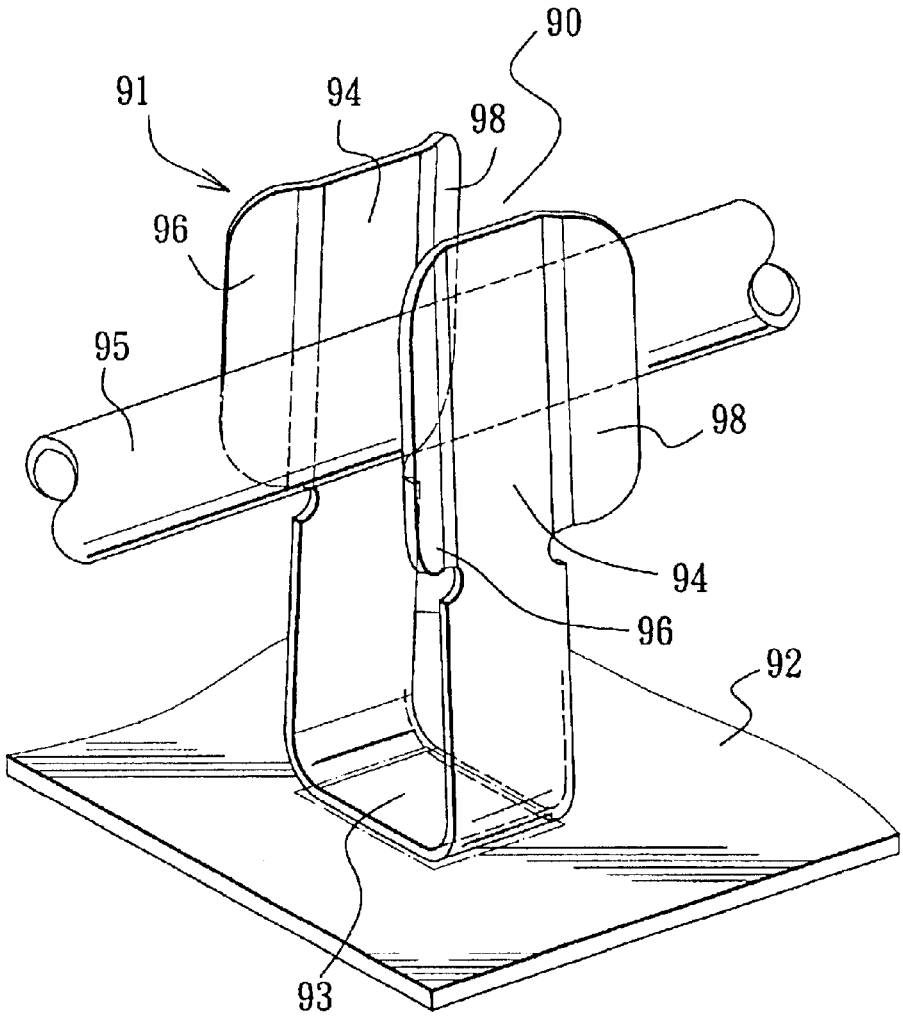
F I G. 1 PRIOR ART
FIG. 1 is a perspective view of a conventional antenna coupler in a state of use.
Figure 2:
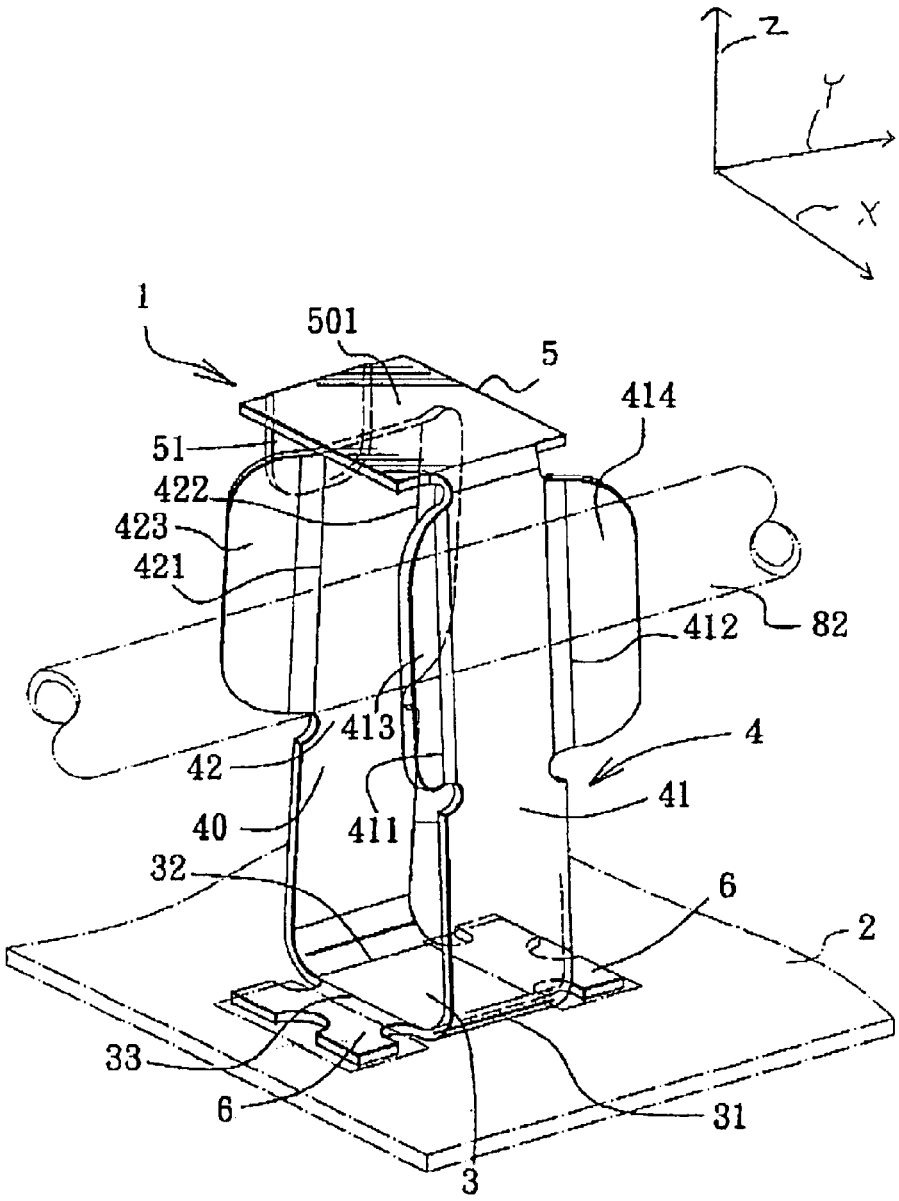
FIG. 2 is a perspective view of the preferred embodiment of an antenna coupler according to the present invention in a state of use.
Figure 3:
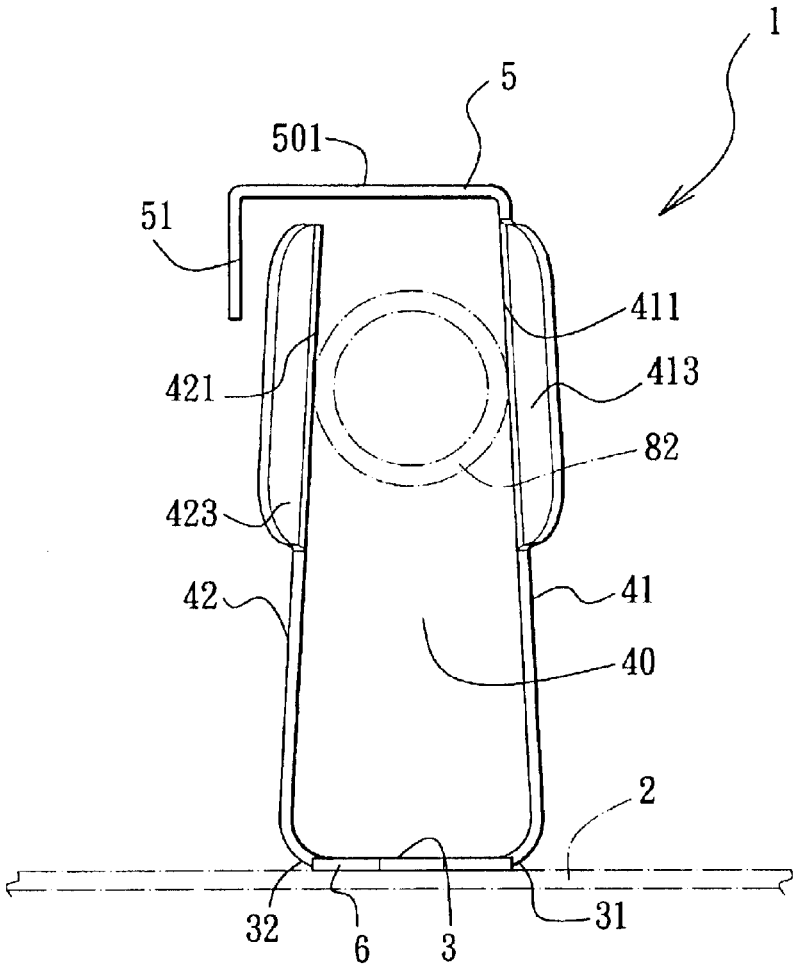
FIG. 3 is a side view of the preferred embodiment in a state of use.
Figure 4:
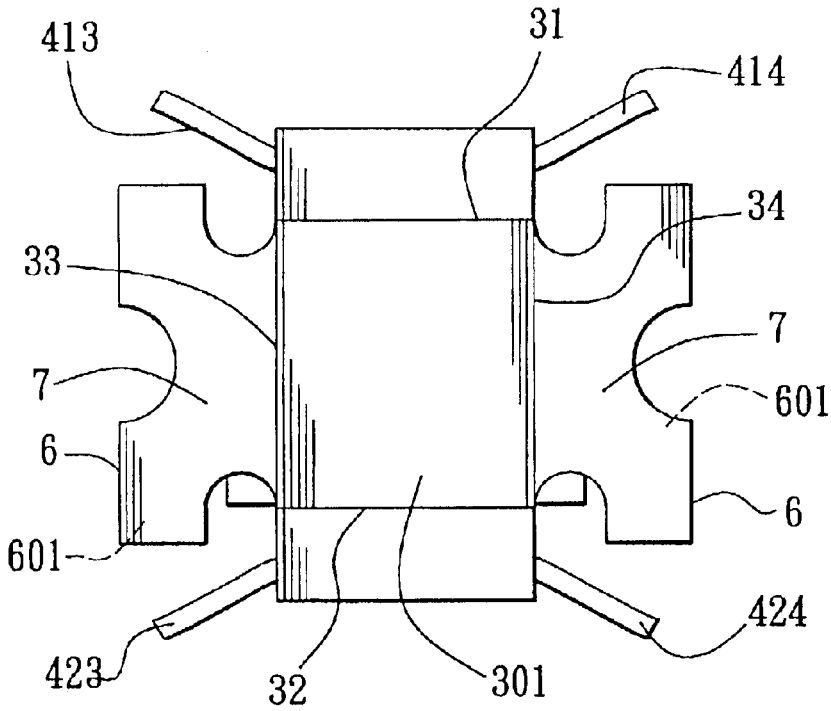
FIG. 4 is a bottom view of the preferred embodiment.

Referring to FIGS. 2 to 4, the preferred embodiment of an antenna coupler 1 according to the present invention is adapted to be mounted on a circuit board 2 for fastening a rod section 82 of an antenna on the circuit board 2. The antenna coupler 1 includes a base part 3, a clamping part 4, a pick-up part 5 and a pair of soldering parts 6.

The base part 3 has a pair of first edge portions 31, 32 opposite to each other in a first direction, and a pair of second edge portions 33, 34 opposite to each other in a second direction transverse to the first direction.

The clamping part 4 includes first and second clamping arms 41, 42 that extend respectively from the first edge portions 31, 32 of the base part 3 in a third direction transverse to the first and second directions. The first and second clamping arms 41, 42 have the same height in the third direction and the same width in the second direction, confine a clamping space 40 therebetween, and are adapted to clamp the rod section 82 of the antenna therebetween. Preferably, the clamping arms 41, 42 extend inclinedly in the third direction toward each other. The clamping arms 41, 42 have adjacent first edges 411, 421 that extend in the third direction and that have a pair of first guide flanges 413, 423 formed respectively thereat, and adjacent second edges 412, 422 that are opposite to the first edges 411, 421 and that have a pair of second guide flanges 414, 424 formed respectively thereat. The first and second guide flanges 413, 423, 414, 424 confine respective first and second converging entrances for guiding insertion of the rod section 82 of the antenna into the clamping space 40.

The pick-up part 5 extends from a distal end of the first clamping arm 41 that is distal from the base part 3 toward the second clamping arm 42 in the first direction, and defines a pick-up surface 501 opposite to the base part 3 and adapted to be applied with a suction force through the use of a suction device (not shown) for moving the antenna coupler 1 onto the circuit board 2. Accordingly, surface mounting of the antenna coupler 1 on the circuit board 2 is facilitated. Moreover, the pick-up part 5 can prevent entanglement among antenna couplers 1 when the latter are collected in one place. The pick-up part 5 can further prevent the antenna coupler 1 from catching cables (not shown) of test equipment (not shown) when the antenna coupler 1 is mounted on the circuit board 2. Preferably, the pickup part 5 includes a restricting extension 51 that extends integrally in the third direction toward the base part 3. The second clamping arm 42 has a distal end disposed between the distal end of the first clamping arm 41 and the restricting extension 51. The restricting extension 51 restricts movement of the second clamping arm 42 in the first direction away from the first clamping arm 41 to avoid damage to the second clamping arm 42 when the rod section 82 of the antenna is clamped by the clamping arms 41, 42.

The soldering parts 6 extend respectively in the second direction from the second edge portions 33, 34 of the base part 3 and are adapted to be soldered on the circuit board 2. As such, aboard-confronting surface 301 of the base part 3 need not be directly soldered onto the circuit board 2 as compared with the prior art. The soldering parts 6 have mounting surfaces 601 plated with a metal film layer 7 for soldering onto the circuit board 2. As such, solder absorption of the soldering parts 6 can be enhanced, and borderlines are formed between the soldering parts 6 and the base part 3 to prevent solder material from spreading over the board-confronting surface 301 of the base part 3. Preferably, the metal film layer 7 is made from a material selected from the group consisting of gold, tin, and a gold alloy and a tin alloy.

In this embodiment, the base part 3, the first and second clamping arms 41, 42, the pick-up part 5 and the soldering parts 6 are formed integrally from a metal plate, such as a copper plate, that is folded at junctions of the base part 3 and the first and second clamping arms 41, 42, and the pick-up part 5 and the first clamping arm 41.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna coupler adapted to be mounted on a circuit board for fastening a rod section of an antenna on the circuit board, said antenna coupler comprising:

a base part having a pair of first edge portions opposite to each other in a first direction, and a pair of second edge portions opposite to each other in a second direction transverse to the first direction;

a clamping part including first and second clamping arms that extend respectively from said first edge portions of said base part in a third direction transverse to the first and second directions, said first and second clamping arms being adapted to clamp the rod section of the antenna therebetween;

a pick-up part extending from a distal end of said first clamping arm that is distal from said base part toward said second clamping arm in the first direction, said pick-up part defining a pick-up surface opposite to said base part and adapted to be applied with a suction force for moving said antenna coupler onto the circuit board; and a soldering part extending in the second direction from at least one of said second edge portions and adapted to be soldered on the circuit board.

2. The antenna coupler as claimed in claim 1, wherein said base part, said first and second clamping arms, said pick-up part and said soldering part are formed integrally from a metal plate that is folded at junctions of said base part and said first and second clamping arms, and said pick-up part and said first clamping arm.

3. The antenna coupler as claimed in claim 1, wherein said pick-up part includes a restricting extension that extends integrally in the third direction toward said base part, said second clamping arm having a distal end disposed between said distal end of said first clamping arm and said restricting extension, said restricting extension restricting movement of said second clamping arm in the first direction away from said first clamping arm.

4. The antenna coupler as claimed in claim 1, wherein said clamping arms confine a clamping space therebetween, said clamping arms having adjacent first edges that extend in the third direction and that have a pair of first guide flanges formed respectively thereat, said first guide flanges confining a first converging entrance for guiding insertion of the rod section of the antenna into said clamping space.

5. The antenna coupler as claimed in claim 4, wherein said clamping arms have adjacent second edges opposite to said first edges and having a pair of second guide flanges formed respectively thereat, said second guide flanges confining a second converging entrance for guiding insertion of the rod section of the antenna into said clamping space.

6. The antenna coupler as claimed in claim 1, wherein said soldering part has a mounting surface plated with a metal film layer for soldering onto the circuit board.

7. The antenna coupler as claimed in claim 6, wherein said metal film layer is made from a material selected from the group consisting of gold, tin, and a gold alloy and a tin alloy.

8. An antenna coupler adapted to be mounted on a circuit board for fastening a rod section of an antenna on the circuit board, said antenna coupler formed from an integrated, folded metal plate and comprising:

a base part section having a pair of first edge portions opposite to each other in a first direction, and a pair of second edge portions opposite to each other in a second direction transverse to the first direction;

a clamping part section including first and second clamping arms that extend respectively from said first edge portions of said base part section in a third direction transverse to the first and second directions, said first and second clamping arms being adapted to clamp the rod section of the antenna therebetween;

a pick-up part section extending from a distal end of said first clamping arm that is distal from said base part toward said second clamping arm in the first direction, said pick-up part defining a pick-up surface opposite to said base part and adapted to be applied with a suction force for moving said antenna coupler onto the circuit board; and a soldering part section extending in the second direction from at least one of said second edge portions and adapted to be soldered on the circuit board.

9. The antenna coupler as claimed in claim 8, wherein said pick-up part section includes a restricting extension extending integrally from a distal end of said pick-up part that is distal from said clamping arm, said restricting extension extending in the third direction toward said base part, said second clamping arm having a distal end disposed between said distal end of said first clamping arm and said restricting extension, said restricting extension structured to restrict movement of said second clamping arm in the first direction away from said first clamping arm.

10. The antenna coupler as claimed in claim 8, wherein said clamping arms confine a clamping space therebetween, said clamping arms having adjacent first edges that extend in the third direction and that have a pair of first guide flanges formed respectively thereat, said first guide flanges confining a first converging entrance for guiding insertion of the rod section of the antenna into said clamping space.

11. The antenna coupler as claimed in claim 10, wherein said clamping arms have adjacent second edges opposite to said first edges and having a pair of second guide flanges formed respectively thereat, said second guide flanges confining a second converging entrance for guiding insertion of the rod section of the antenna into said clamping space.

12. The antenna coupler as claimed in claim 8, wherein said soldering part has a mounting surface plated with a metal film layer for soldering onto the circuit board.

13. The antenna coupler as claimed in claim 12, wherein said metal film layer is made from a material selected from the group consisting of gold, tin, and a gold alloy and tin alloy.

* * * * *